US005399140A

United States Patent [19]

Klippel

[11] Patent Number: 5,399,140

[45] Date of Patent: Mar. 21, 1995

[54] BALANCING SPORT BOARD

[76] Inventor: Kevin L. Klippel, 360 Auburn Way, #14, San Jose, Calif. 95129

[21] Appl. No.: 268,031

[22] Filed: Jun. 29, 1994

[51] Int. Cl.[6] ..... A63B 22/14; A63B 22/16

[52] U.S. Cl. ..... 482/146; 482/71; 482/123; 482/130; 482/51

[58] Field of Search ..... 482/51, 71, 121, 123, 482/129, 130, 142, 146, 79

[56] References Cited

U.S. PATENT DOCUMENTS

| | | | |
|---|---|---|---|
| 3,582,066 | 6/1971 | Keryluk | 482/146 |
| 3,834,693 | 9/1974 | Poppenberger | 482/146 |
| 4,183,521 | 1/1980 | Kroeker | 482/146 |
| 4,605,224 | 8/1986 | Torii | 482/146 |
| 4,618,145 | 10/1986 | Inada | 482/146 |
| 4,629,181 | 12/1986 | Kriue | 482/146 |
| 4,907,796 | 3/1990 | Roel-Rodriquez | 482/71 |
| 4,946,160 | 8/1990 | Berteletti | 482/146 |
| 5,002,272 | 3/1991 | Hofmeister | 482/146 |
| 5,342,266 | 8/1994 | Dailey | 482/146 |

*Primary Examiner*—Richard J. Apley
*Assistant Examiner*—Lynne A. Reichard
*Attorney, Agent, or Firm*—Thomas E. Schatzel

[57] ABSTRACT

A balancing sport including an elongated platform for receiving a participant. A lower surface of the platform is attached to two sectors which ate rotatable about two shafts positioned along a common horizontal axis of rotation. Each shaft is secured about a sector post anchored to a horizontal planar board. The lower surface of the board is attached to a pivot means with the board being pivotable about a vertical axis of rotation. The pivot means is attached to a rectangular plank movable along a linear horizontal axis. The lower surface of the plank includes attached axles with wheels attached. Each wheel is positioned within track rails projecting perpendicular and away from the bottom surface of the plank. Each track rail extends longitudinally parallel relative to one another and the linear axis. The vertical axis is positioned in an offset location about the plank allowing an oscillation to occur when the platform is rotated about the horizontal axis, thereby permitting the platform to move laterally with little assistance from the participant. Elastic means attached about the front and rear of the plank tend to urge the plank toward a center location of the sport platform when used. Thus, the platform is revolvable about a horizontal and vertical axes of rotation, and is movable laterally along a linear axes.

9 Claims, 2 Drawing Sheets

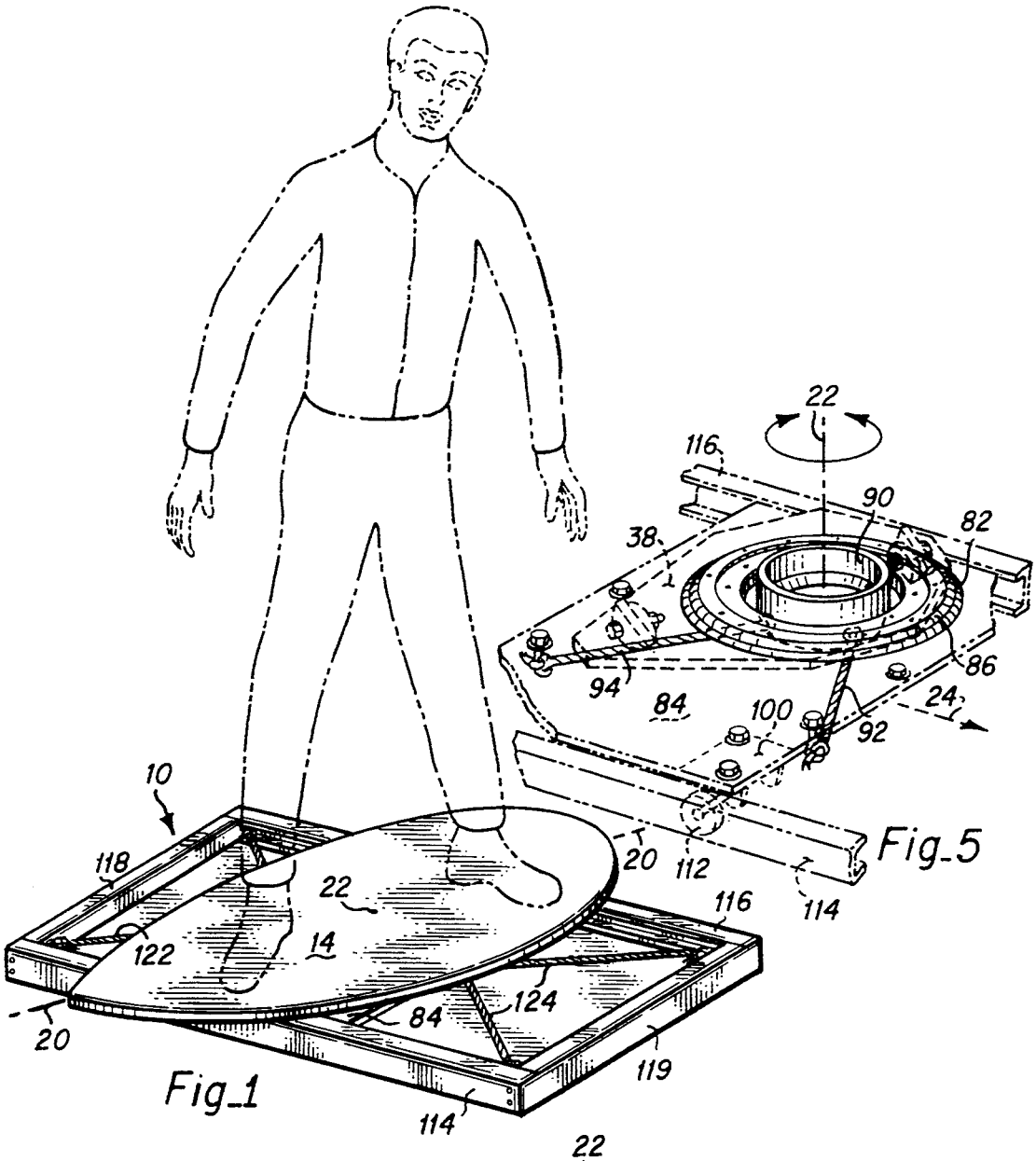
Fig_5
Fig_1
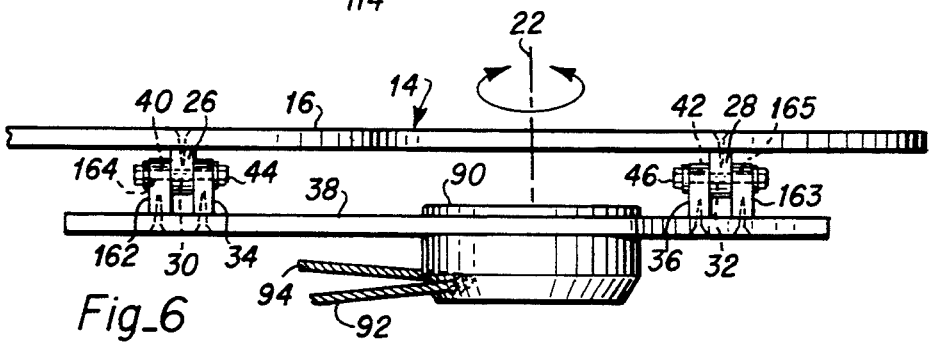
Fig_6

BALANCING SPORT BOARD

BACKGROUND OF THE INVENTION

1. Field of the Invention

This invention relates generally to a balancing platform and more particularly to a pivotal platform which moves about a horizontal and vertical axis of rotation offering movement on a horizontal plane in reaction to a participant's displacement of weight on the platform and a participant's movement of turning the deck on said vertical axis.

2. Description of the Prior Art

Balancing platforms may be utilized for recreational purposes; teaching people balancing, proper edging and banking techniques; and/or body weight equilibrium techniques relating to many sports activities. Many competitive athletes, particularly surfers, snowboarders and skateboarders, utilize balancing platforms to improve their balancing, edging, banking and/or steering anticipation skills. These board sports require that participants dedicate many hours of practice to improve the athlete's balancing skills. Therefore, balancing platforms are in public demand because they allow a person to improve balance, are enjoyable to use and may be sufficiently small for home use and accessibility.

Prior art balancing boards include U.S. Pat. No. 4,505,477 issued to John M. Wilkinson. The '477 balancing board moves in a linear direction on top of two wheels but does not include a pivotal vertical axis of rotation or a radial horizontal axis of rotation.

The "Advanced Balancing Board" of U.S. Pat. No. 5,190,506 issued to Daniel M. Zubik, is a freestyle board which is not utilized inside a frame.

SUMMARY OF THE PRESENT INVENTION

It is therefore an object of the present invention to provide a balancing platform which is enjoyable to utilize.

Another object of the present invention is to provide a balancing platform which is inexpensive to manufacturer.

Another object of the present invention is to provide a balancing platform which can be utilized indoors or outdoors.

Another object of the present invention is to provide a balancing platform which can assist in improving a person's balancing, turning, banking, edging and other athletic skills.

Briefly, a preferred embodiment of the present invention includes an elongated platform for receiving a participant. A lower surface of the platform is attached to two sectors which are rotatable about two shafts positioned along a common horizontal axis of rotation. Each shaft is secured about a sector post anchored to a horizontal planar board. The lower surface of the board is attached to a pivot means with the board being pivotable about a vertical axis of rotation. The pivot means is attached to a rectangular plank movable along a linear horizontal axis. The lower surface of the plank includes attached axles with wheels attached. Each wheel is positioned within track rails projecting perpendicular and away from the bottom surface of the plank. Each track rail extends longitudinally parallel relative to one another and the linear axis. The vertical axis is positioned in an offset location about the plank allowing an oscillation to occur when the platform is rotated about the horizontal axis, thereby permitting the platform to move laterally with little assistance from the participant. Elastic means are attached about the front and rear of the plank to urge the plank toward a center location of the sport platform when used. Thus, the platform is simultaneously revolvable about a horizontal axis of rotation, a vertical axis of rotation, and movable laterally along a linear axes.

An advantage of the present invention is that it provides a balancing platform which is enjoyable to utilize.

Another advantage of the present invention is that it provides a balancing platform which is inexpensive to manufacturer.

Another advantage of the present invention is that it provides a balancing platform which can be utilized indoors or outdoors.

Another advantage of the present invention is that it provides a balancing platform which can assist an athlete in improving the athlete's balancing, turning, banking, edging and other athletic skills.

These and other objects and advantages of the present invention will no doubt become obvious to those of ordinary skill in the art after having read the following detailed description of the preferred embodiment which is illustrated in the various drawing figures.

BRIEF DESCRIPTION OF THE DRAWINGS

FIG. 1 is a perspective view of a balancing sport board of the present invention in use by a participant;

FIG. 5 is a partially sectioned perspective view of the pivot means of the balancing sport board of FIG. 1; and FIG. 6 is a partial side view of an alternative embodiment of the balancing sport board of the present invention with an alternative means for securing the balancing sport platform.

DETAILED DESCRIPTION OF THE PREFERRED EMBODIMENT

Figure 2:
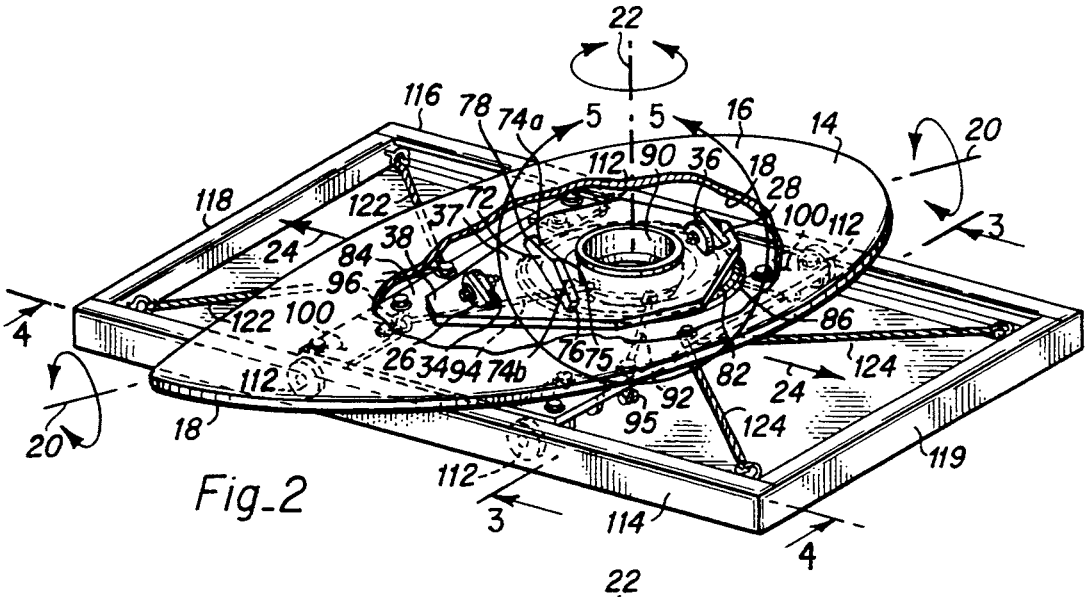
FIG. 2 is a partially sectioned, perspective view of the balancing sport board of FIG. 1.

FIGS. 1–5 show a balancing sport board of the present invention and referred to by general reference 10, with FIG. 1 illustrating a participant in position for operating the board 10. The sport board 10 includes an oblong elongated platform 14 having an upper surface 16 to receive a participant and a lower surface 18. The platform 14 preferably has an elongated oblong shape similar to a small surfboard and is approximately three feet in length, two feet wide at the maximum width and less than one inch thick. The platform 14 is revolvable about a horizontal axis of rotation 20 and a vertical axis of rotation 22. Also, the platform is movable laterally along a linear axis 24. The platform 14 is movable about axes 20, 22 and 24 responsive to the weight displacement of the participant supported by the platform 14 as illustrated in FIG. 1.

A first and second sector 26 and 28 is attached to and projects from the lower surface 18 of the platform 14 and positioned along the horizontal axis 20. The sectors 26 and 28 are positioned about opposite sides of the vertical axis 22. Sectors 26 and 28 include an aperture 30 and 32, respectively, coaxial with the horizontal axis of rotation 20.

A pair of sector posts 34 and 36 are attached to a top surface 37 of a horizontal planar board 38. The posts 34 and 36 are positioned adjacent and between each sector 26 and 28, respectively. Each sector post 34 and 36 includes an aperture 40 and 42, respectively, .positioned adjacent to apertures 30 and 32, respectively, and coaxial with horizontal axis 20. Sectors 26 and 28 are pivotably secured with sector post 34 and 36, respectively, by a pair of cylindrical pivot shafts 44 and 46. Shafts 44 and 46 are indexable through sector apertures 30 and 32 and sector post apertures 40 and 42, respectively. Both shafts 44 and 46 are aligned, coaxially with horizontal axis 20. Each shaft 44 and 46 is secured on the entering side by a head 48 and 50, respectively, which is wider than the sector post apertures 40 and 42. The opposite end of each shaft 44 and 46 is threaded to receive a threaded nut 56 and 58 of a diameter greater than apertures 40 and 42, respectively. Thus the shafts 44 and 46 are secured within the apertures 30 and 40, and 32 and 42, respectively. Each sector 26 and 28 is rotatable about the horizontal axis 20 and attached shafts 44 and 46. Thus, the platform 14 rotates about the axis 20 responsive to weight displacement of the participant supported on the top surface 16 of the platform 14.

Figure 3:
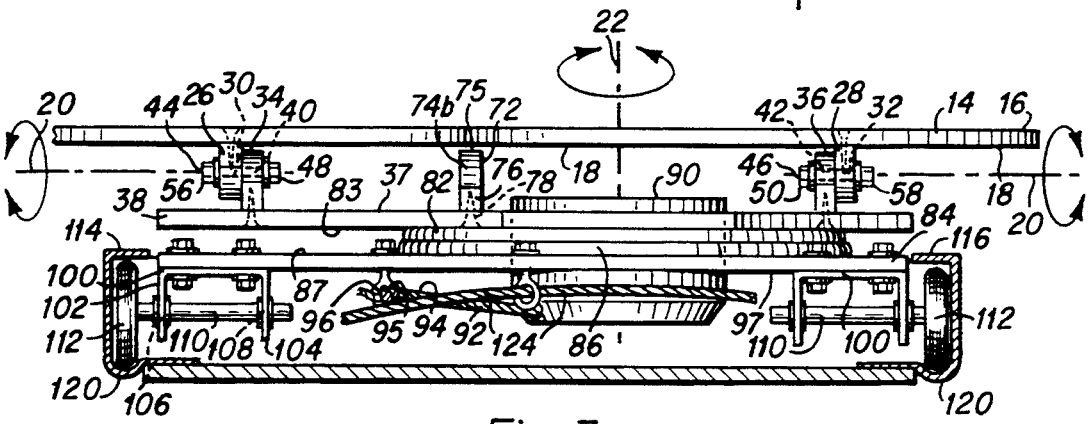
FIG. 3 is a cross-sectional view of the balancing sport board of FIG. 2 taken along the line 3—3.
Figure 4:
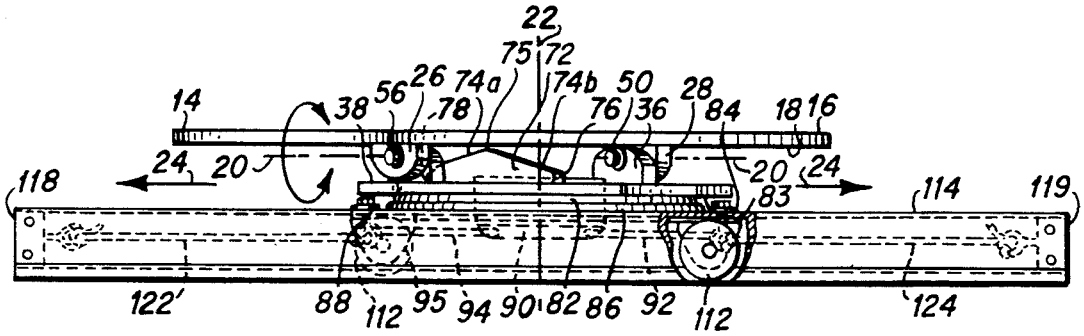
FIG. 4 is a cross-sectional view of the balancing sport board of FIG. 2 taken along the line 4—4.

Referring to FIGS. 2–3, attached to the top surface 37 of the planar board 38 and positioned between the sector posts 34 and 36 is an elongated triangular segment 72. The segment 72 has flat surfaces positioned perpendicular to the horizontal axis 20 and perpendicular to the surface 37. A top surface 74 of the segment 72 has two equally sloped edges 74*a* and 74*b* joined at an apex 75 which is parallel to the axis of rotation 20 with the edges 74*a* and 74*b* sloped away from the apex 75 toward a pair of opposite terminal ends 76 and 78. Segment 72 is positioned slightly below the lower surface 18 of the platform 14 to support and allow the platform 14-to move about axis 20. The segment 72 serves as a stop to prevent the bottom surface 18 of the platform 14 from contacting any parts other than sectors 26 and 28 and one of the top surfaces 74*a* or 74*b*.

Referring to FIGS. 2–5, a revolvable pivot means comprised of a circular ring 82 is attached to a bottom surface 83 of the board 38 and coaxial with axis 22. Positioned below the board 38 and ring 82 is a rectangular horizontal plank 84 supporting a second circular ring 86 attached to a top surface 87 of the plank 84 and coaxial with axis 22. Ring 86 has an internal channel track 88 of a C-shaped cross-section with an outer diameter slightly larger than the outer diameter of ring 82 to receive the ring 82, such that the ring 82 may slide within the channel as the board 38 rotates about the axis 22. The C-shaped channel track 88 faces ring 82 which contains an exterior edge positioned and movable within 88 to allow ring 82 to rotate three hundred and sixty degrees about the vertical axis 22. Operationally, such pivot means is analogous to a lazy Susan structure, supported on the horizontal plank 84. Thus, responsive to the twisting motion of the participant on the platform 14, the platform 14 and board 38 rotate about the vertical axis 22.

About the vertical axis 22 is an elongated hollow cylinder 90 with a top end attached to the board 38 and a bottom end extending through the plank 84 to an elevation beneath the bottom surface of the plank 84. Two resilient ropes 92 and 94, e.g. bungie cords, are each anchored, at one end, to the cylinder 90 beneath the plank 84. The anchor points of the ropes 92 and 94 are one hundred eighty degrees apart. A second end of each of the ropes 92 and 94 is attached to the plank 84 at laterally spaced anchors 95 and 96, respectively. The anchors 95 and 96 are also each positioned remotely from the cylinder 90. Thus, when the board 38 and platform 14 rotate about the vertical axis 22, each of the ropes 92 and 94 are placed in a tension mode and the combined effort of the resilient ropes 92 and 94 produce a force urging the board 38 and platform 14 to the starting neutral position. At the neutral position, each of the resilient ropes 92 and 94 apply equal, but opposite force on the cylinder relative to the axis of rotation 22. With the cylinder 90 being attached to the board 38, such force of the resilient ropes 92 and 94 is delivered to board 38. Thus, as the participant attempts to rotate the platform 14 about axis 22, an opposing force is created through the resilient ropes 92 and 94.

A bottom surface 97 of the rectangular plank 84 anchors a set of four U-shaped shaft supports 100 attached about each corner. Each support 100 includes two legs 102 and 104 extending perpendicular and away from the bottom surface 97. The legs 102 and 104 have a pair of aligned apertures 106 and 108, respectively, extending parallel with the front and rear side of the plank 84. The front two corner supports 100 are positioned with their apertures 106 and 108 in alignment, and the rear two corner supports 100 are positioned with their apertures 106 and 108 in alignment.

A cylindrical axle 110 is mounted inside and extending parallel within each aperture 106 and 108, and anchored to the support 100. A wheel 112 is attached to a terminal end of each axle 110 farthest from the center of the platform 10 such that it may rotate about the axis of the attached axle 110.

Two rails 114 and 116 are positioned parallel relative to one another, extending adjacent each lateral side of the plank 84 and parallel with the linear axis 24. Rails 114 and 116 are each of a reversed J-shape, to receive and direct two sets of wheels 112. Rails 114 and 116 each have an open side for receiving the wheels 112. A pair of terminal walls 118 and 119 about each terminal end of each rail 114 and 116 (See FIG. 2) provide a stop to contain the wheels 112 and 117 within the slots of the rails 114 and 116. A bottom side 120 of each rail 114 and 116 forms a trough running surface for directing the wheels 112 in a parallel direction. Thus, responsive to a participant's weight and force the plank 87 moves along the rails 114 and 116 which are parallel with the linear axis 24.

The terminal walls 118 and 119 and rails 114 and 116 are joined together to form a rectangular base. Two elastic ropes 122 and 124, e.g. bungie cords, are attached at the middle of each side of the plank 84. Rope 122 has opposing ends attached at opposite ends of wall 118. Rope 124 has opposing ends attached at opposite ends of wall 119. Thus, each rope 122 and 124 tends to urge with equal but opposing forces the plank 84 towards the middle location of the tracks 114 and 116. Thus, the resultant neutral position of plank 84 is toward the longitudinal middle location of the rails 114 and 116. Thus, a participant may overcome the force in of the ropes 122 and 124 in one direction by the participant's movements and shifting of weight on the platform 14.

The vertical axis of rotation 22 is positioned in a laterally offset location about the plank 84 to allow for oscillations to occur when the platform 14 is rotated about the horizontal axis of rotation 20. The oscillation allows the platform 14 to move laterally along the linear axis 24 with little assistance from the participant. Thus, in operation, a participant may create and control motion about the horizontal axis of rotation 20, about the vertical axis of rotation 22 and lateral movement along the linear axis 24.

An alternative embodiment for securing sectors 26 and 28 with board 38 is illustrated in FIG. 6. A pair of second sector posts 162 and 163 are attached to the top surface 37 and positioned adjacent each sector 26 and 28, respectively, and opposite sector posts 34 and 36, respectively. Each sector post 162 and 163 include an aperture 164 and 165 in alignment with apertures 30 and 40, and 32 and 42, respectively. Shafts 44 and 46 are indexed through apertures 30, 40 and 164, and 32, 42 and 165, respectively, securing sectors 26 and 28 with sector posts 34 and 162, and 36 and 163, respectively.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alterations and modifications as fall within the true spirit and scope of the invention.

I claim:

1. A balancing sport platform comprising:

an elongated platform including an upper surface to receive a participant and a lower surface;

a first and a second sector attached to said lower surface, the first and second sectors being rotatable about a cylindrical pivot shaft positioned and extending along a common horizontal axis of rotation and secured about a sector post;

a horizontal planar board, said sector post being attached to a top surface of the horizontal planar board and a lower surface of the board being attached to a pivot means with the board being pivotable about a vertical axis of rotation;

a rectangular plank movable along a linear horizontal axis and secured to said pivot means;

a resilient means having a first end attached to the plank and a second end attached to the pivotable board for urging the board to a starting position;

track rails attached to each corner of said bottom surface of the plank and projecting perpendicular and away from said bottom surface of the plank, each track rail extending longitudinally parallel relative to one another and with said linear axis;

a plurality of cylindrical axles mounted adjacent to each of the track rails and to the plank;

a wheel attached to the end of each axle and positioned within the track rails, each of the wheels being rotatable about said attached axle and within at least one of the track rails, the two rails being positioned parallel relative to one another and including an open side for receiving the wheels, each rail forming a trough for directing each wheel in a parallel direction, and a stop means about each end of each rail to contain said wheels within said troughs;

a first elastic means with a first end attached to a secured area positioned forward of the plank and a second end attached to the plank to urge the plank forward; and a second elastic means with a first end attached to a secured area positioned behind the plank and a second end attached to the plank to urge the plank backward, the combined first and second elastic means tending to urge the plank toward the center location of the sport platform when used.

2. The balancing sport platform of claim 1 further including a cylindrical member engaged at one end to the platform and an opposite end to the plank, means engaged to the cylindrical member to permit rotation of the cylindrical member about a vertical axis of rotation; whereby the platform may be rotated about said axis of rotation independent of the plank.

3. The balancing sport platform of claim 2 further including a first resilient means attached to the cylindrical member to oppose rotation of the cylindrical member about the vertical axis of rotation.

4. The balancing sport platform of claim 3 further including an elongated segment attached to said top surface of the board and extending perpendicular to said horizontal axis of rotation for supporting said platform and preventing the bottom surface of said platform from contacting said board or said plank.

5. The balancing sport platform of claim 4 wherein said pivot means includes a circular ring attached to said top surface of the plank and containing a C-shaped ridge with the open side facing the center of the ring; and a second circular ring of a diameter smaller than the first circular ring, attached to said bottom surface of the board and containing an exterior edge positioned and movable within the C-shaped ridge of the first circular ring allowing the second circular ring to rotate three hundred and sixty degrees about said vertical axis.

6. The balancing sport platform of claim 5 further including an elongated cylinder about said vertical axis of rotation with the top attached to said pivotable board and the bottom extending through and underneath said plank; and the resilient means having a first end attached to the bottom surface of said plank and a second end attached to the lower portion of the cylinder for urging the board to a starting position.

7. The balancing sport platform of claim 6 further including a second resilient means having a first end attached to the bottom surface of said plank about a location remote from the first resilient means first end, and a second end attached to the lower portion of the cylinder for urging the board to a starting position.

8. The balancing sport platform of claim 6 wherein the biasing means for allowing each wheel to move in a parallel direction is comprised of the bottom side of each rail containing a trough along the wheel-engaging running surface.

9. The balancing sport platform of claim 8 wherein the vertical axis is positioned in an offset location about the plank allowing an oscillation to occur when the platform is rotated about the horizontal axis, thereby permitting the platform to move laterally with little assistance from the participant.

* * * * *